US005462165A

United States Patent [19]

Thuer

[11] Patent Number: 5,462,165

[45] Date of Patent: Oct. 31, 1995

[54] PAPER REEL, PAPER REEL UNPACKING STATION FOR UNPACKING THE PAPER REEL, AND PROCESS FOR UNPACKING THE PAPER REEL

[75] Inventor: Walter Thuer, Friedberg, Germany

[73] Assignee: MAN Roland Druckmaschinen AG, Offenbach, Germany

[21] Appl. No.: 219,640

[22] Filed: Mar. 29, 1994

[30] Foreign Application Priority Data

Apr. 1, 1993 [DE] Germany ..... 43 10 675.7

[51] Int. Cl.[6] ..... B65D 85/66; B65B 43/26

[52] U.S. Cl. ..... 206/410; 53/381.1; 53/382.1; 53/384.1; 53/492; 206/398; 229/202; 229/239

[58] Field of Search ..... 206/398, 400, 206/410; 229/201, 202, 239; 53/381.1, 381.7, 382.1, 384.1, 492

[56] References Cited

U.S. PATENT DOCUMENTS

| | | | |
|---|---|---|---|
| 3,021,047 | 2/1962 | Pottle et al. | 229/239 |
| 3,343,746 | 9/1967 | Shiffman | 229/239 |
| 5,282,346 | 1/1994 | Masuda et al. | 53/492 |

FOREIGN PATENT DOCUMENTS

| | | |
|---|---|---|
| 384410 | 11/1987 | Austria . |
| 1123254 | 9/1956 | France . |
| 943040 | 11/1955 | Germany . |
| 97389 | 5/1973 | Germany . |
| 2337663 | 2/1975 | Germany . |
| 8802205 | 5/1988 | Germany . |
| 8600239 | 8/1987 | Netherlands . |

OTHER PUBLICATIONS

Patent Abstracts of Japan, vol. 13, No. 392, Aug. 30, 1989, and JP 1139324.

*Primary Examiner*—W. Donald Bray
*Attorney, Agent, or Firm*—Cohen, Pontani, Lieberman, Pavane

[57] ABSTRACT

A paper reel having a tear-off wire on its curved outer surface. The tear-off wire in turn has a catch clip at its front end. The paper reel is deposited on a paper reel unpacking station so as to be rotatable. The unpacking station includes a tear-off table which can be moved in the longitudinal and transverse directions relative to the paper reel has a catch hook which receives the catch clip of the paper reel when the tear-off table is correspondingly positioned at the end side of the paper reel. After the winding of the tear-off wire at the end side is removed from the paper reel, the tear-off table is moved further on a frame parallel to the longitudinal axis of the paper reel, while the paper reel rotates at the same time that the tear-off wire is being unwound until the tear-off table arrives at the second end side of the paper reel.

24 Claims, 2 Drawing Sheets

PAPER REEL, PAPER REEL UNPACKING STATION FOR UNPACKING THE PAPER REEL, AND PROCESS FOR UNPACKING THE PAPER REEL

BACKGROUND OF THE INVENTION

1. Field of the Invention

The invention is directed to a paper reel which is enclosed at least on its curved outer surface by a layer of packaging and has a tear-off wire between the roll of paper and the layer of packaging for removing the layer of packaging.

The invention is likewise directed to a paper reel unpacking station for unpacking the paper reel, and to a process for unpacking the paper reel in the paper reel unpacking station.

2. Description of the Prior Art

When unpacking a paper reel of the kind used in web-fed rotary presses and which does not have a tear-off wire, a known problem is that the outer layers of paper on the paper reel are damaged when the packaging is ripped off. But in order for the paper reel to be suitable for automatic reel changing in a reel changer arranged upstream of the printing machine, all paper layers which are damaged in some way must be cut away.

Thus, waste paper is formed by the layers of paper which must be removed. At the same time, a working force is required for this purpose which must be overseen to ensure that all of the damaged paper layers are removed so that the new paper reel can be prepared for the automatic gluing process.

A process and a device for removing the packaging from a paper reel is known from DD 97 389. A first set of cutting tools serve to remove the end sides of the packaging and a second set of cutting tools serve to remove the packaging from the curved outer surface area of the paper reel. The fact that two different types of knives are needed is, in itself, indicative of the high technical cost of this unpacking station. Moreover, it does not ensure that the outer paper layers of the roll will not be damaged.

Another manner of removing the packaging is known from DE 23 37 663 C2. This reference teaches a paper reel having a tearing ribbon beneath its packaging in the longitudinal direction which is used to tear off the packaging manually.

SUMMARY OF THE INVENTION

Accordingly, it is an object of the present invention to provide a paper reel which can be unpacked by an automatic device without damaging the outer paper layers. Pursuant to this object, one aspect of the present invention resides in a paper reel which is enclosed at least on its curved outer surface by packaging layer and has a tear-off ribbon arranged between the role of paper and the packaging layer to facilitate removal of the packaging layer. The tear-off ribbon ends in a member which can be gripped by a gripping device and is provided on the curved outer surface near one of the end sides of the paper reel or, when the packaging layer also covers the end sides of the paper roll, on one of the end sides in the vicinity of the outer surface of the paper reel. Preferably, the member to be gripped is located outside of the packaging layer.

Another object of the invention is to provide an automatic device which ensures that the inventive paper reel described above will be unpacked without damaging the paper. Pursuant to this object, another aspect of the present invention resides in a paper reel unpacking station for unpacking the paper reel. In this unpacking station two rotatable rolls are arranged parallel to one another for supporting and rotating the paper reel. A tear-off table is provided so that the paper reel, together with the rotatable rolls, and the tear-off table are movable relative to one another in a longitudinal direction of the paper reel. The tear-off table has a gripping device for gripping the member at the end of the tear-off ribbon, so that the tear-off ribbon can be pulled off the paper reel in the longitudinal direction of the reel in that the tear-off table moves away from the paper reel or in that the paper reel moves away from the tear-off table. The ribbon is pulled off in the circumferential direction of the paper reel by rotating the paper while simulataneously pulling the ribbon with a pulling device.

The advantages of this solution consist in that the removal of damaged paper layers is dispensed with, the packaging on the end sides and on the curved outer surface is removed by the same technical means, and no dangerous cutting tools are required which could cause injury to operators.

The paper reel unpacking station has two essential component parts, two rotating rolls arranged parallel to one another for supporting and rotating the paper reels on the one hand and a tear-off table on the other hand. These two component pans are arranged so as to be movable relative to one another. Thus, it is sufficient to arrange one component part so as to be stationary and the other so as to be movable. This is realized either by supporting the rotating rolls so as to be movable, e.g. on a driverless transport vehicle which accordingly also serves as a pan of the paper reel unpacking station, or by supporting the rotating rolls so as to be stationary, but arranging the tear-off table so as to be movable with respect to the rotating rolls and accordingly with respect to the paper reel. However, in the latter case the paper reel must first be loaded on to the rotating rolls by a transport vehicle.

A process for unpacking this paper reel by means of the paper reel unpacking station is provided according to claim 18.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

DETAILED DESCRIPTION OF THE PREFERRED EMBODIMENTS

Figure 1:
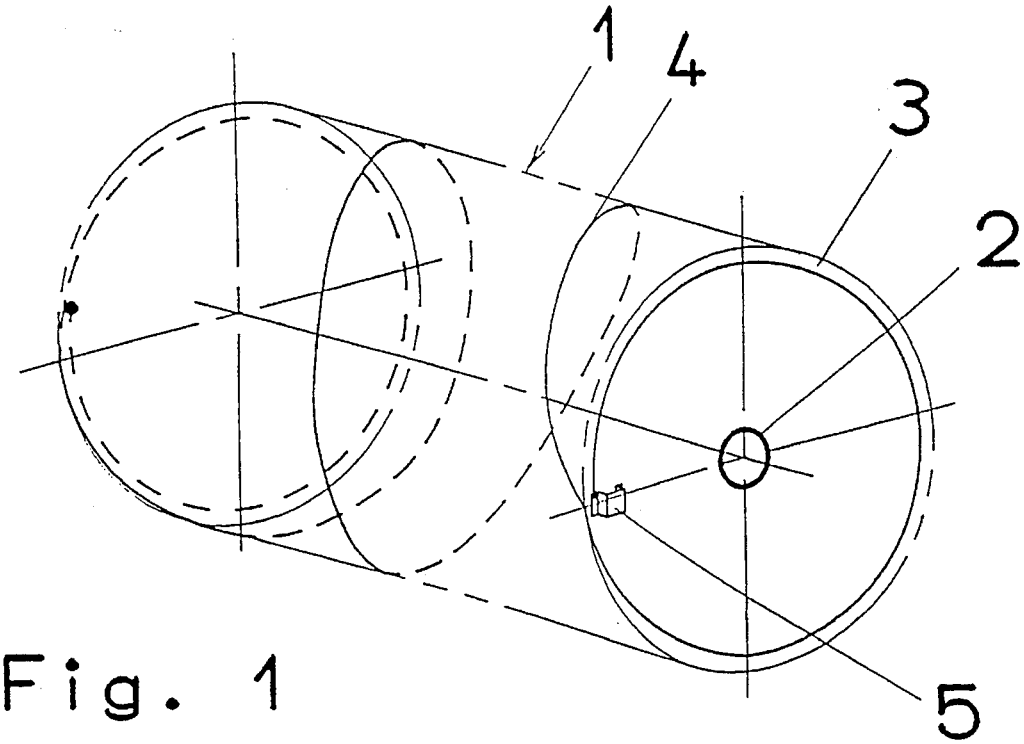
FIG. 1 shows a perspective view of a paper reel pursuant to the present invention.

A paper reel 1, shown in FIG. 1, which has a paper web wound around a tube 2 in multiple layers so as to form a roll of paper, is covered by a packaging layer 3 on its curved outer surface. Between the packaging layer 3 and the roll of paper on the paper reel 1, a tear-off ribbon 4 is wound in a spiral, preferably in a right-handed direction, around the curved outer surface area of the paper reel 1 between the two end sides of the paper reel 1. The tear-off ribbon 4 is preferably arranged in one layer so as to terminate on the end sides. On the front end side, the tear-off ribbon 4 has a catch clip 5 at its front end. The catch clip 5 is formed, for example, by a loop or piece of sheet metal as shown in FIG. 1.

The paper reel need not necessarily be packaged on the curved surface area as well as on the end sides. Rather, it is sufficient that it be enclosed by a packaging layer only on the curved surface area. Rather than being wound on in a spiral, the tear-off ribbon 4 can also simply form two loops either on the curved outer surface close to the end sides or on each of the end sides close to the curved outer surface, while merely running parallel to the longitudinal axis of the paper reel 1 on the curved outer surface side. Instead of using the catch clip 5, the tear-off ribbon 4 can also terminate in a member of another kind which can be grasped by a gripping device. Before the unpacking process, this member is either still located beneath the packaging layer 3 so that it must be taken out of the packaging layer 3 manually or mechanically and opened out from the paper reel 1 or it is already arranged so that it may be grasped from the outside by means of a gripping device.

Figure 2:
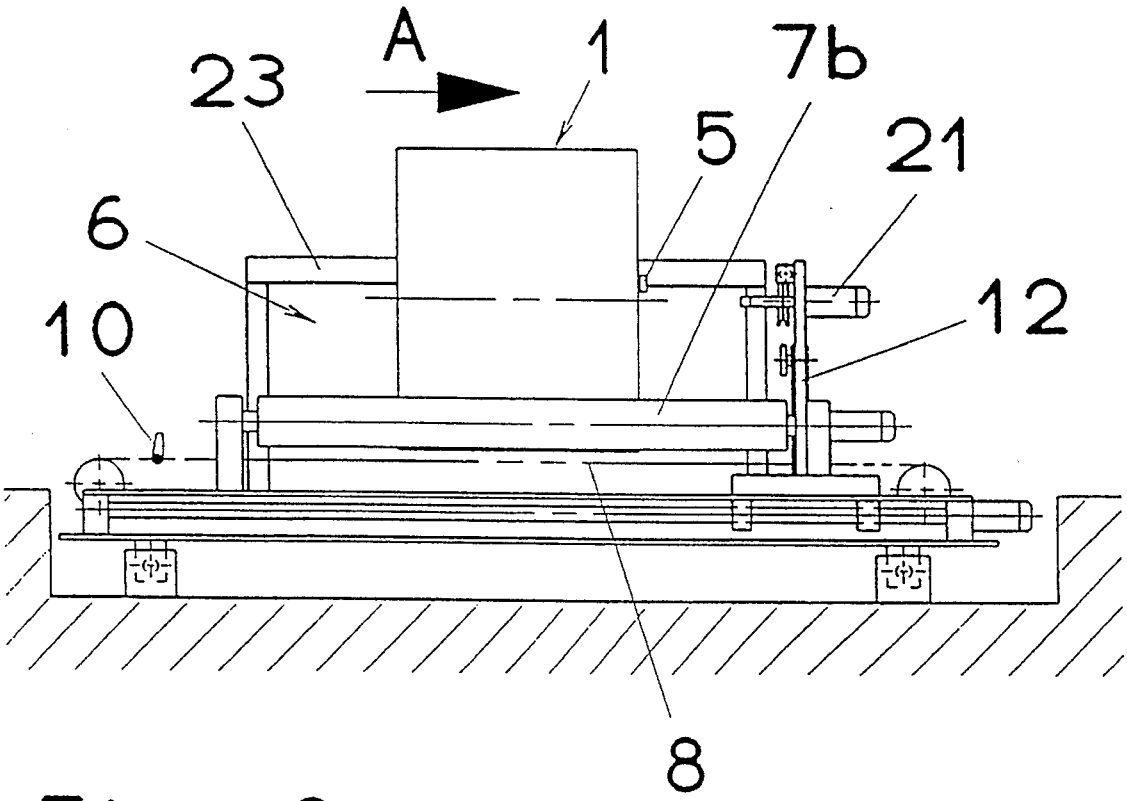
FIG. 2 shows a side view of a paper reel unpacking station, loaded with the paper reel according to FIG. 1.
Figure 4:
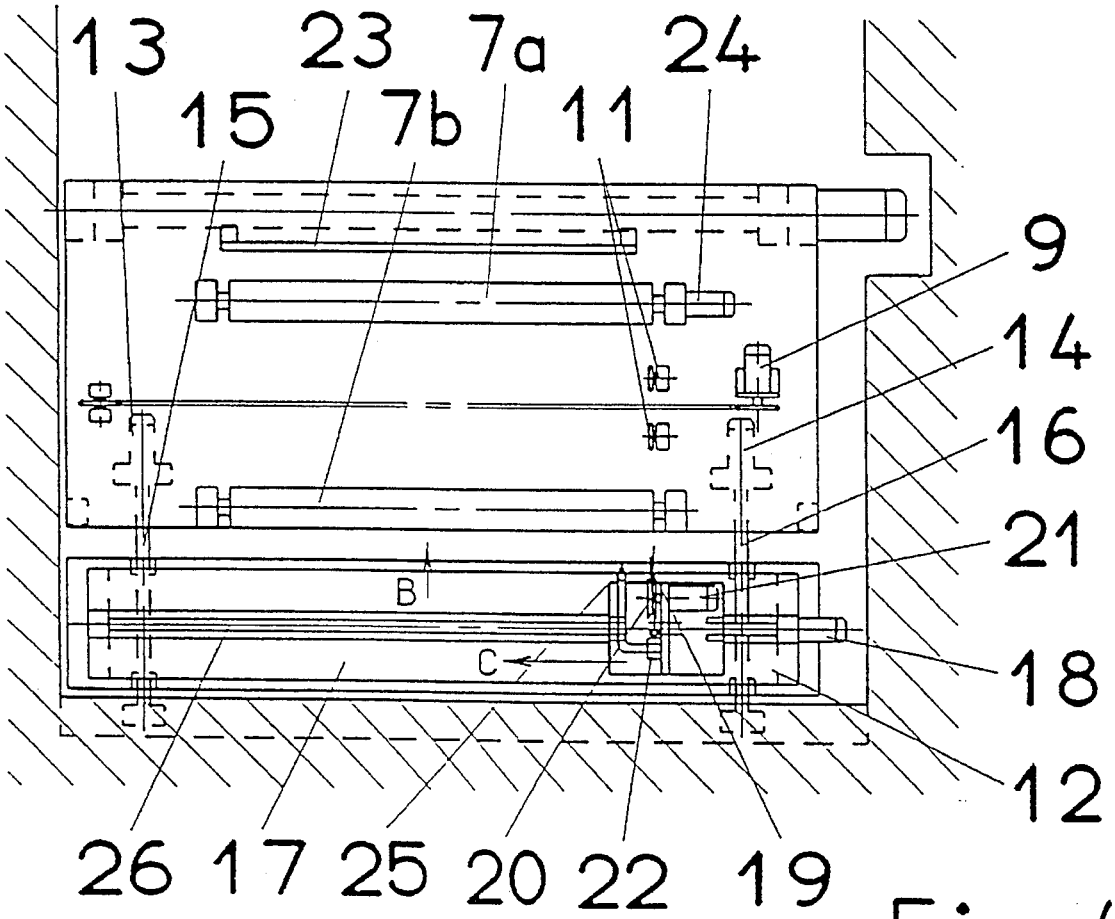
FIG. 4 shows a top view of the paper reel unpacking station.

A paper reel 1 according to FIG. 1 is unloaded onto an unpacking station 6 shown in FIG. 2 by means of a transport device, e.g. a driverless transport vehicle, and a lifting mechanism. The paper reel 1 is rotatably supported on two rotating rolls 7*a*, 7*b* as shown in FIG. 4. The reel 1 is displaceable on the rotating rolls 7*a*, 7*b* in the direction of arrow A by means of a positioning drive 8. The positioning drive 8 is driven by a motor 9. The paper reel 1 is moved in the direction of the stops 11 by a driver 10 fastened to the positioning drive 8 until the paper reel 1 abuts against the stops 11, whereupon the unpacking position of the paper reel 1 is reached. The driver 10 is supported on the positioning drive 8 so that the driver 10 folds over as soon as the paper reel 1 strikes against the stops 11, dips under the paper reel 1, and travels back into the initial position. Thus the motor 9 advantageously requires only one rotating direction. Furthermore, it is not necessary to supply the control with information concerning the roll width.

The motor 9 is switched off by means of an inductive or capacitive detecting device when reaching the initial position of the driver 10.

The paper reel unpacking station 6 has a tear-off table 12 which is movable in the radial direction of the paper reel 1 on a frame 17 which can be moved by means of at least one motor 13 and preferably by a second motor 14 as well as associated threaded drives 15, 16. Furthermore, the tear-off table 12 is arranged on the frame 17 so as to be movable by means of a motor 18 in the longitudinal direction of the paper reel 1 by a threaded drive 26.

The tear-off table 12 is outfitted with a catch hook 19 for catching the catch clip 5, a bobbin 20 which supports the catch hook 19 and serves for winding on the tear-off ribbon 4, and a motor 21 for rotating the bobbin 20. A light transmitting and receiving element 22 which transmits light in the direction of the paper reel 1 and receives it again when it is reflected by the reflector strip 23 is located at the height of the catch hook 19 on the tear-off table 12. The reflector strip 23 extends along the entire length of the rotating rolls 7*a*, 7*b* or preferably along the length of the frame 17.

When the tear-off table 12 is located at the height of the stops 11 as shown in FIG. 4, the light radiated from the light transmitting and receiving element 22 is reflected back from the reflector strip 23 to the light transmitting and receiving element 22 just past the end side of the paper reel 1 facing the tear-off table 12. In order to rotate the rotating rolls 7*a*, 7*b* in the direction of the arrow D in FIG. 3, at least one of the rolls, e.g. rotating roll 7*a*, is driven by a motor 24.

Before the catch hook 19 can be brought into position, the position of the catch clip 5 at the paper reel 1 must be detected. This is effected by rotating the paper reel 1 by means of the rotating roll 7*a* until the beam path of the light barrier is interrupted by the catch clip 5. The catch clip 5 may be located on the side of the catch hook 19 or so as to be offset relative to the latter by approximately 180°. In order that the catch clip 5 is not in the way when positioning the catch hook, the paper reel 1 is rotated e.g. by 90° so that the catch clip 5 is safely out of the way. The tear-off table 12 moves on the frame 17 in the direction of arrow B in FIG. 4 toward the paper reel 1 until an end-position switch 25 arranged at the tear-off table 12 contacts the paper reel 1 and the movement of the tear-off table 12 in the direction of arrow B is stopped by a signal of the end-position switch 25. The catch hook 19 is now located in a position in front of the end side of the paper reel 1 for receiving the catch clip 5. After less than a complete revolution of the paper reel 1 in the direction of arrow D in the counterclockwise direction, the catch clip 5 is caught by the catch hook 19. Because of the tensile stress exerted on the catch hook 19 by the catch clip 5 and tear-off ribbon 4, the motor 21 which drives the bobbin 20 is set in motion. When the tear-off ribbon 4 is wound on the paper reel 1 in the form of a right-handed spiral as shown in FIG. 1, the paper reel 1 is rotated in a counterclockwise direction in that the rotating rolls 7*a*, 7*b* rotate in a clockwise direction. The layers of the tear-off ribbon 4 arranged on the end side are first wound off the paper reel 1 onto the bobbin 20 which likewise rotates in the counterclockwise direction. The bobbin 20 is preferably dimensioned so that it is capable of receiving the quantity of ribbons 4 torn off in the course of a day when unwinding the paper reels in a printing plant.

After a revolution of 360°, the portion of the packaging layer 3 of the paper reel 1 at the end side is removed.

The tear-off table 12 must now be moved on the frame 17 parallel to the longitudinal axis of the paper reel 1, while the paper reel 1 rotates at the same time. In so doing, the ratio of the circumferential speed of the paper reel 1 to the forward feed rate of the tear-off table 12 should correspond to the tangent of the pitch angle or angle of slope of the tear-off table 4 formed by the tear-off ribbon 4 on the outer surface area with the longitudinal axis of the paper reel 1.

When light is reflected again from the reflector strip 23 after the tear-off table 12 moves past the paper reel 1 longitudinally, this is recorded by the light transmitting and receiving element 22. The movement of the tear-off table 12 in the direction of arrow C in FIG. 4 is then stopped and after another 360-degree revolution of the paper reel 1, the tear-off ribbon 4 is wound off from the second end face of the paper reel 1 until the end of the ribbon.

The tear-off table 12 is now moved away from the paper reel 1 again opposite the direction of arrow B by means of the motors 13 and 14 and back into the initial position opposite the direction of arrow C.

The paper reel 1 is loaded again on a driverless transport vehicle by means of the lifting mechanism and is transported, for example to a reel changer of a printing machine.

Figure 3:
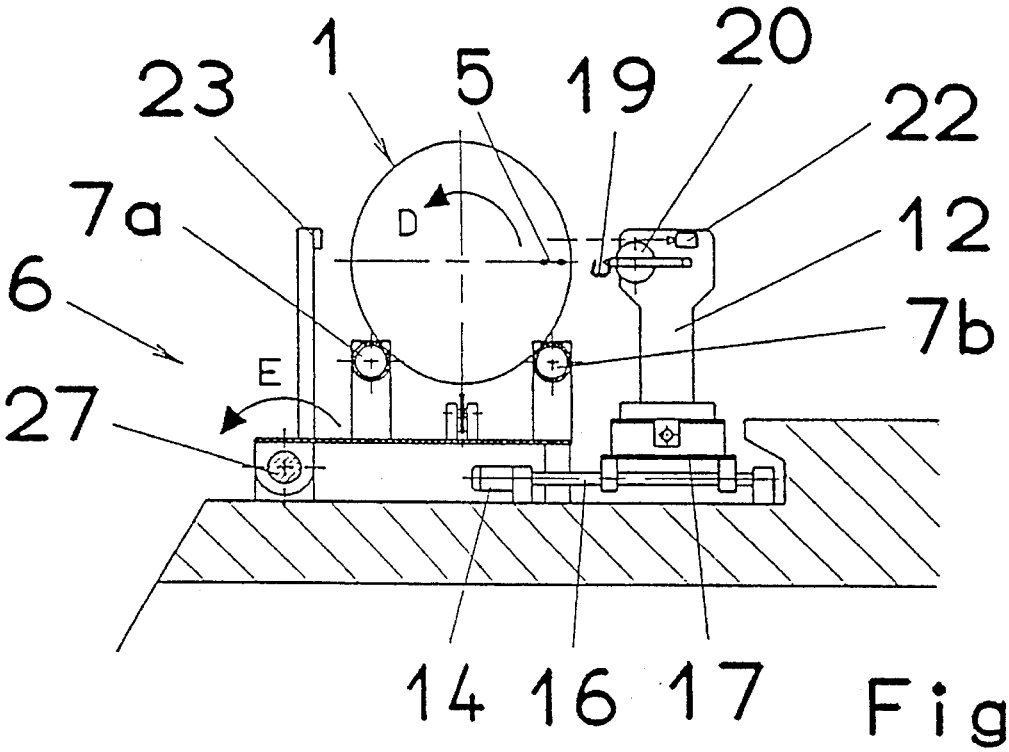
FIG. 3 shows a front view of the paper reel unpacking station.

The paper reel unpacking station 6 is preferably arranged so as to be swivelable upward in the direction of arrow E in FIG. 3 around a rotational axis 27. In the swiveled up position, packaging waste falls from the paper reel unpacking station 6 and can be disposed of. After this process, the paper reel unpacking station 6 is again ready for use.

Instead of the embodiment of the paper reel unpacking station 6 described above, the paper reel unpacking station 6 can also be constructed of two component parts which are movable relative to one another. The first component part is a support for the paper reel 1 with the rotating rolls 7*a* and 7*b*. The second component part is the tear-off table 12. At least one of these component parts is arranged so as to be movable relative to the other. For example, the rotating rolls 7*a*, 7*b* are constructed as part of a driverless transport vehicle so that the paper reel 1 remains on this transport vehicle during the unpacking. On the other hand, it is possible for the paper reel 1 to be unloaded by the driverless transport vehicle onto the rotating rolls 7*a*, 7*b* as shown above and for the tear-off table 12 to be movable relative to the paper reel only in the longitudinal direction. This is sufficient, for example, when the catch clip 5 or, more generally, a member to be gripped at the end of the tear-off ribbon 4 can be gripped already from the longitudinal side of the paper reel 1 by a gripping device which is preferably fastened to the tear-off table 12. However, it is also possible to arrange the two parts so as to be movable individually in the longitudinal direction of the paper reel 1. In order to pull the tear-off ribbon 4 from the paper reel 1 in a paper reel unpacking station 6 of this type, it is sufficient that the rotating rolls 7*a*, 7*b* rotate so that the tear-off ribbon 4 is unwound in the circumferential direction of the paper reel 1 and that the paper reel 1 and tear-off table 12 move away from one another so that the tear-off ribbon 4 can be pulled off from the paper reel 1 in the longitudinal direction of the paper reel 1. This is done by means of a pulling device which is either preferably fastened to the tear-off table 12 or is a stationary rotating arm which pulls the tear-off ribbon 4 off the paper reel 1 by means of a rotating movement away from the paper reel 1.

In general, a gripping device which grips a member to be gripped at the end of the tear-off ribbon 4 can be installed on the paper reel unpacking station 6 instead of the catch clip 5 and the catch hook 19 described above. The gripping device is preferably arranged at the end of a winding device formed by the bobbin 20 in the embodiment described above and is driven by the motor 21.

According to the invention, a paper reel 1 is provided which has a tear-off ribbon 4 on its curved outer surface area. The tear-off ribbon 4 in turn has a catch clip 5 at its front end. A paper reel constructed in this way can easily be freed from its packaging layer 3 in a paper reel unpacking station 6 according to the invention.

The paper reel 1 is deposited on the paper reel unpacking station 6 so as to be rotatable. A tear-off table 12 which can be moved in the longitudinal and transverse directions relative to the paper reel 1 has a catch hook 19 which receives the catch clip 5 of the paper reel 1 when the tear-off table 12 is correspondingly positioned at the end side of the paper reel 1. The position of the tear-off table 12 is monitored by a light transmitting and receiving element 22 which radiates light onto a reflector strip 23. After the winding of the tear-off ribbon 4 at the end side is removed from the paper reel 1, the tear-off table 12 is moved further on the frame 17 parallel to the longitudinal axis of the paper reel 1, while the paper reel 1 rotates at the same time that the tear-off ribbon 4 is being unwound until the tear-off table 12 arrives at the second end side of the paper reel 1 which is in turn detected by the light transmitting and receiving element 23. The paper reel 1 is removed from the paper reel unpacking station 6 by means of a driverless transport vehicle and a lifting mechanism on the paper reel unpacking station 6. A wire, strip, thread and the like can also be used instead of the tear-off ribbon 4.

The invention is not limited by the embodiments described above which are presented as examples only but can be modified in various ways within the scope of protection defined by the appended patent claims.

I claim:

1. A paper reel comprising: a paper roll with a curved outer surface and end sides; a packaging layer enclosing at least the curved outer surface of the paper roll; a tear-off ribbon arranged between the paper roll and the packaging layer so as to facilitate removal of the packaging layer; and a grippable member provided at an end of the tear-off ribbon.

2. A paper reel according to claim 1, wherein the packaging layer is provided so as to also cover the end sides of the paper roll.

3. A paper reel according to claim 2, wherein the grippable member is arranged on one of the end sides of the paper roll near the curved outer surface of the paper roll.

4. A paper reel according to claim 1, wherein the grippable member is arranged on the curved outer surface of the paper roll near one of the end sides.

5. A paper reel according to claim 1, wherein the grippable member is arranged to be outside the packaging layer.

6. A paper reel according to claim 1, wherein the grippable member is a catch clip.

7. A paper reel according to claim 1, wherein the tear-off ribbon forms a loop between the paper roll and the packaging layer one of on the curved outer surface near each of the end sides and on each of the end sides near the curved outer surface so as to facilitate separation of a portion of the packaging layer on the end side of the reel from a portion of the packaging layer on the curved outer surface of the reel.

8. A paper reel according to claim 1, wherein the tear-off ribbon is wound in a spiral on the curved outer surface of the paper roll.

9. A paper reel according to claim 1, wherein the tear-off ribbon is one of a wire, a strip and a thread.

10. A paper reel unpacking station for unpacking a paper reel having a curved outer surface enclosed by a packaging layer, a tear-off ribbon arranged between the paper reel and the packaging layer, and a grippable member connected to the tear-off ribbon, the unpacking station comprising: two rotatable rolls arranged parallel to one another so as to support and rotate the paper reel; and a tear-off table, the paper reel, together with the rotatable rolls, and the tear-off table being movable relative to one another in a longitudinal direction of the paper reel, the tearoff table having gripping means for gripping the grippable member of the tear-off ribbon so that the tear-off ribbon can be pulled off the paper reel in the longitudinal direction of the paper reel by one of moving the tear-off table away from the paper reel and moving the paper reel away from the tear-off table, the tear-off table further having a pulling device provided so as to pull the tear-off ribbon in a circumferential direction of the paper reel by rotating the paper reel while simultaneously pulling with the pulling device.

11. A paper reel unpacking station according to claim 10, and further comprising a driverless transport vehicle on which the rotating rolls are located, the tear-off table being arranged so as to be stationary, and the paper reel can be unpacked by the tear-off table.

12. A paper reel unpacking station according to claim 10, wherein the rotatable rolls and the paper reel arranged thereon are stationary, the tear-off table being movable at least in a longitudinal direction relative to the paper reel.

13. A paper reel unpacking station according to claim 10, wherein the gripping means is a catch hook.

14. A paper reel unpacking station according to claim 10, wherein the tear-off table is arranged on the end side of the paper reel so as to be movable.

15. A paper reel unpacking station according to claim 10, wherein the pulling device is a winding device which is arranged on the tear-off table for winding up the tear-off ribbon as it is pulled off during unpacking of the paper reel.

16. A paper reel unpacking station according to claim 14, and further comprising drive means for moving the tear-off table in a transverse direction relative to the paper reel, said drive means including at least one first motor and at least one individual threaded drive.

17. A paper reel unpacking station according to claim 12, and further comprising a frame on which the tear-off table is arranged and a second motor for moving the tear-off table longitudinally to the paper reel.

18. A paper reel unpacking station according to claim 10, wherein the tear-off table has light transmitting and receiving means for detecting the length of the paper reel.

19. A paper reel unpacking station according to claim 18, wherein the paper reel has a central longitudinal axis, the light transmitting and receiving means being arranged at the height of the central longitudinal axis of the paper reel, the paper reel lying between the light transmitting and receiving means and a reflector strip, light radiated by the light transmitting and receiving means only being received again by the light transmitting and receiving means when the light is reflected by the reflector strip.

20. A paper reel unpacking station according to claim 15, wherein the winding device includes a bobbin and a motor for driving the bobbin, the gripping device being arranged so as to be rotatable on the bobbin.

21. A paper reel unpacking station according to claim 12, and further comprising a positioning drive having a driver for moving the paper reel in the direction of the longitudinal axes of the rotatable rolls.

22. A paper reel unpacking station according to claim 21, and further comprising stops which limit the longitudinal movement of the paper reel, the driver being provided so as to fold and dip under the paper reel when the paper reel engages with the stops.

23. A process for winding off a paper reel having a curved outer surface enclosed by a packaging layer, a tear-off ribbon wound in a spiral on the curved outer surface beneath the packaging layer, and a grippable member at the end of the tear-off ribbon at one end of the paper reel, with a paper reel unpacking station having two rotatable rolls arranged parallel to one another so as to support the paper reel, a tear-off table, the paper reel and the tear-off table being movable relative to one another in a longitudinal direction of the paper reel, gripping means for gripping the grippable member, and a pulling device for pulling the tear-off ribbon, the process comprising the steps of: initially arranging the tear-off table so that its end side is at a distance from the paper reel; rotating the paper reel with the rotatable rolls; catching the grippable member with the gripping means as the paper reel rotates on the rotatable rolls; moving the tear-off table longitudinally along the paper reel while the paper reel is simultaneously rotated by the rotatable rolls; determining a ratio of circumferential speed of the paper reel to speed of the tear-off table by a tangent of an angle of slope of the tear-off ribbon with the longitudinal axes of the paper reel; and stopping the tear-off table after reaching a second end of the paper reel.

24. A process according to claim 23, wherein the pulling device of the paper reel unpacking station is a winding device for winding on the tear-off ribbon, the process including initiating the winding device with an impulse occurring with the catching of the grippable member, and terminating the winding-on with the winding device when the second end of the paper reel is reached.

* * * * *